US010839754B2

(12) United States Patent
Kim et al.

(10) Patent No.: US 10,839,754 B2
(45) Date of Patent: Nov. 17, 2020

(54) ORGANIC LIGHT EMITTING DISPLAY HAVING MULTIPLEXER FOR DISTRIBUTING DATA VOLTAGES

(71) Applicant: LG Display Co., Ltd., Seoul (KR)

(72) Inventors: Kyujin Kim, Paju-si (KR); Joohee Lee, Paju-si (KR); Taehun Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 69 days.

(21) Appl. No.: 16/110,407

(22) Filed: Aug. 23, 2018

(65) Prior Publication Data

US 2019/0080652 A1 Mar. 14, 2019

(30) Foreign Application Priority Data

Sep. 13, 2017 (KR) ..... 10-2017-0117323

(51) Int. Cl.
*G09G 3/30* (2006.01)
*G09G 3/36* (2006.01)
*G09G 3/3291* (2016.01)

(52) U.S. Cl.
CPC ... *G09G 3/3291* (2013.01); *G09G 2300/0443* (2013.01); *G09G 2300/0452* (2013.01); *G09G 2300/0819* (2013.01); *G09G 2300/0842* (2013.01); *G09G 2310/0248* (2013.01); *G09G 2310/0262* (2013.01); *G09G 2310/0291* (2013.01); *G09G 2310/0297* (2013.01); *G09G 2320/045* (2013.01)

(58) Field of Classification Search
CPC ..... G09G 3/30–3291; G09G 3/12
See application file for complete search history.

(56) References Cited

U.S. PATENT DOCUMENTS

2006/0071884 A1* 4/2006 Kim ..... G09G 3/3233 345/76
2006/0151745 A1* 7/2006 Kim ..... G09G 3/325 252/301.16
2008/0062089 A1* 3/2008 Kim ..... G09G 3/3275 345/76

(Continued)

FOREIGN PATENT DOCUMENTS

KR 10-2014-0064158 A 5/2014
KR 10-2016-0130028 A 11/2016

*Primary Examiner* — Sanghyuk Park
(74) *Attorney, Agent, or Firm* — Seed Intellectual Property Law Group LLP

(57) ABSTRACT

An organic light emitting display device using a multiplexer includes a display panel, a data driver, and a multiplexer. The display panel includes first to fourth data lines and first to fourth pixels respectively connected to the first to fourth data lines. The data driver includes a first output buffer supplying a data voltage to the first and third data lines and a second output buffer supplying a data voltage to the second and fourth data lines. The multiplexer distributes the data voltage from the first output buffer to the first and third data lines in a time division manner and distributes the data voltage from the second output buffer to the second and fourth data lines in a time division manner. The multiplexer connects a data line, which is not connected to the first and second output buffers, among the first to fourth data lines, to an initialization voltage line providing an initialization voltage.

18 Claims, 13 Drawing Sheets

(56) References Cited

U.S. PATENT DOCUMENTS

| | | | | |
|---|---|---|---|---|
| 2009/0251455 | A1* | 10/2009 | Park | G09G 3/2007 345/214 |
| 2011/0164015 | A1* | 7/2011 | Kim | G09G 3/3275 345/211 |
| 2017/0243528 | A1* | 8/2017 | Ji | G09G 3/2003 |
| 2017/0336851 | A1* | 11/2017 | Bae | G06F 1/3265 |

* cited by examiner

ORGANIC LIGHT EMITTING DISPLAY HAVING MULTIPLEXER FOR DISTRIBUTING DATA VOLTAGES

CROSS-REFERENCE TO RELATED APPLICATION(S)

This application claims the benefit of Korea Patent Application No. 10-2017-0117323 filed on Sep. 13, 2017, the entire contents of which is incorporated herein by reference for all purposes as if fully set forth herein.

BACKGROUND

Technical Field

The present disclosure relates to an organic light emitting display.

Description of the Related Art

An active matrix type organic light emitting display device includes a self-luminous organic light emitting diode (OLED) and has a high response speed, high luminous efficiency, brightness, and a wide viewing angle.

The organic light emitting diode, which is a self-luminous device, includes an anode electrode, a cathode electrode, and organic compound layers (HIL, HTL, EML, ETL, and EIL) formed therebetween. The organic compound layers include a hole injection layer (HIL), a hole transport layer (HTL), an emission layer (EML), an electron transport layer (ETL), and an electron injection layer (EIL). When a driving voltage is applied to the anode electrode and the cathode electrode, holes passing through the HTL and electrons passing through the ETL are transferred to the EML to form excitons, and as a result, the EML generates visible light.

As resolution of display devices increases, the size of data drivers for driving data lines increases. Generally, each of the data lines is supplied with a data voltage supplied from one output channel. In order to reduce the size of data drivers, a method of distributing one output channel to two or more data lines in a time division manner is used. When the data voltage is distributed to the data lines using a multiplexer, a data line which does not receive the data voltage is in a floating state.

In an organic light emitting display device using an internal compensation method, a data voltage applied to a pixel is stored in a specific node connected to a gate node of a driving transistor in a state in which a threshold voltage of the driving transistor is reflected. Thus, in the organic light emitting display device on the basis of the internal compensation scheme, while the data voltage is not applied using the multiplexer, a data voltage of a previous frame is stored in the data line in the floating state and as a result, the data voltage of the previous frame affects when current data is written.

Further, a data driver in which output order of data voltages is set again according to a pixel array when the data voltages are distributed using a multiplexer must be manufactured.

BRIEF SUMMARY

An organic light emitting display device of the present disclosure includes a display panel, a data driver, and a multiplexer. The display panel includes first to fourth data lines and first to fourth pixels respectively connected to the first to fourth data lines. The data driver includes a first output buffer supplying data voltages to the first and third data lines, and a second output buffer supplying data voltages to the second and fourth data lines. The multiplexer distributes the data voltages from the first output buffer to the first and third data lines in a time division manner and distributes the data voltages from the second output buffer to the second and fourth data lines in a time division manner. The multiplexer connects at least one of the first to fourth data lines, which is not connected to the first and second output buffers, to an initialization voltage line providing an initialization voltage.

In another embodiment, the present disclosure provides a device that includes a display panel, a data driver, and a multiplexer. The display panel includes a plurality of pixels arranged in a plurality of horizontal pixel lines and a plurality of pixel columns, and a plurality of data lines, with each of the data lines being electrically connected to a respective one of the pixel columns. The data driver includes a plurality of output buffers. The multiplexer is electrically coupled between the data driver and the display panel. The multiplexer is configured to, during a first time period: electrically couple a first output buffer to a first data line; electrically couple a second output buffer to a second data line, the second data line being adjacent to the first data line; electrically couple a third data line to an initialization voltage, the third data line being between the second data line and a fourth data line; and electrically couple the fourth data line to the initialization voltage.

BRIEF DESCRIPTION OF THE SEVERAL VIEWS OF THE DRAWINGS

The above and other aspects, features, and advantages of the present disclosure will be more clearly understood from the following detailed description taken in conjunction with the accompanying drawings, in which.

DETAILED DESCRIPTION

Hereinafter, embodiments of the present disclosure will be described with reference to the accompanying drawings.

Figure 1:
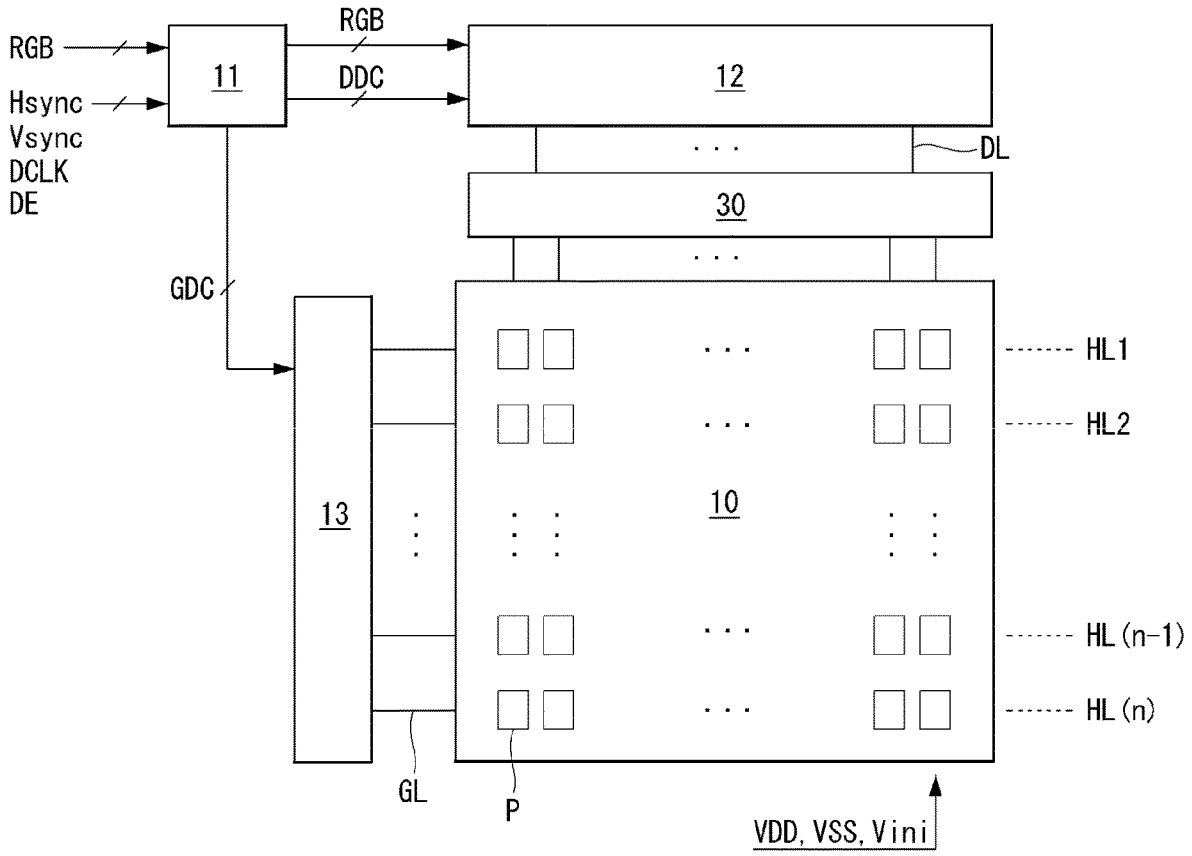
FIG. 1 is a view illustrating an organic light emitting display device according to an embodiment of the present disclosure.

FIG. 1 is a view illustrating an organic light emitting display device according to an embodiment of the present disclosure.

Referring to FIG. 1, an organic light emitting display device according to an embodiment of the present disclosure includes a display panel 10, a data driver 12, a gate driver 13, and a timing controller 11.

A plurality of data lines DL and a plurality of gate line units GL intersect each other in the display panel 10, and pixels P are arranged in a matrix form in each of the intersection regions. The term "intersect" is used herein in its broadest sense to include within the meaning that one element crosses over or overlaps another element, and does not necessarily require that the two elements contact each other. For example, the data lines DL and the gate line units GL may overlap, and thus intersect with each other, but may be physically separated from one another, for example, by one or more layers or elements provided there between. It also includes within its meaning, in some embodiments, that the lines or elements can contact each other. Each of the pixels P is supplied with a high potential driving voltage VDD and a low potential driving voltage VSS from a power generation unit (not shown).

The timing controller 11 generates a data control signal DDC for controlling operation timing of the data driver 12 and a gate control signal GDC for controlling operation timing of the gate driver 13 on the basis of a vertical synchronization signal Vsync, a horizontal synchronization signal Hsync, a dot clock signal DCLK, a data enable signal DE, and the like.

The data driver 12 generates a data voltage on the basis of the data control signal DDC and image data supplied from the timing controller 11 and supplies the data voltage to the data lines DL. A multiplexer 30 may be electrically coupled between the data driver 12 and the display panel 10, as shown in FIG. 1.

The gate driver 13 generates a gate signal on the basis of the gate control signal GDC from the timing controller 11. Here, the gate signal may include a scan signal and an emission signal. The gate driver 13 may be formed in the form of a gate-driver in panel (GIP) directly on the display panel 10.

Figure 2:
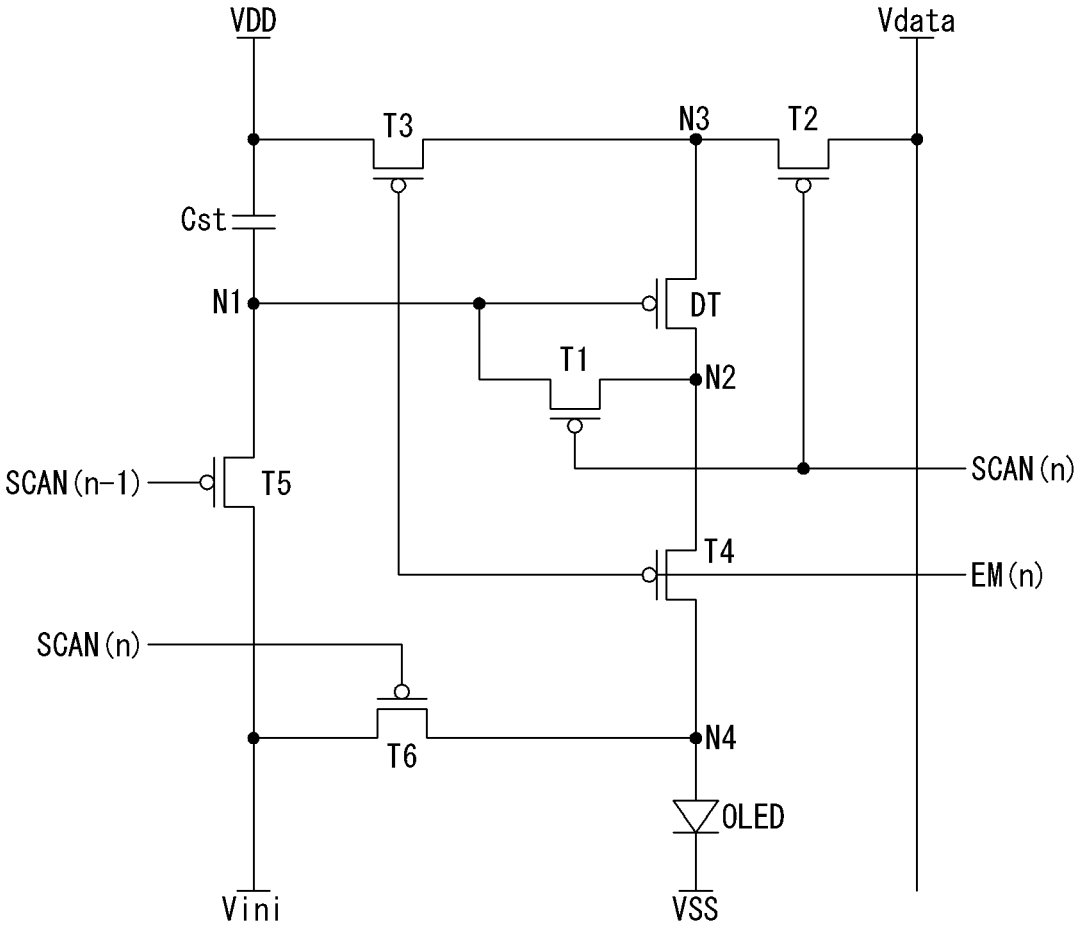
FIG. 2 is a circuit diagram of a pixel according to an embodiment.

FIG. 2 is a view illustrating an example of a pixel for performing an internal compensation operation. In particular, FIG. 2 illustrates a pixel disposed in an nth pixel line HLn. Hereinafter, an internal compensation method based on the pixel illustrated in FIG. 2 will be described.

Referring to FIGS. 1 and 2, the pixel according to an embodiment includes a driving transistor DT, first through sixth transistors T1 to T6, and a storage capacitor Cst. The gate line unit GL includes a scan line supplied with a scan signal SCAN(n) and an emission line supplied with an emission signal EM(n).

The driving transistor DT controls a driving current applied to the organic light emitting element OLED according to a source-gate voltage Vgs thereof. A gate electrode of the driving transistor DT is connected to a first node N1, a source electrode thereof is connected to a third node N3, and a drain electrode thereof is connected to a second node N2. The first transistor T1 connects the first node N1 and the second node N2 in response to an n-th scan signal SCAN(n). The second transistor T2 connects the data line DL and the third node N3 in response to the n-th scan signal SCAN(n). The third transistor T3 connects the third node N3 and an input terminal of the high potential driving voltage VDD in response to an n-th emission signal EM(n). The fourth transistor T4 connects the second node N2 and the fourth node N4 in response to the n-th emission signal EM(n). The fifth transistor T5 connects the first node N1 and an input terminal of an initialization voltage Vini in response to an (n−1)th scan signal SCAN(n−1), which may be a scan signal from an immediately prior pixel line, e.g., a scan signal from the n−1th pixel line HL(n−1). The sixth transistor T6 connects the input terminal of the initialization voltage Vini and the fourth node N4 in response to the n-th scan signal SCAN(n). The storage capacitor Cst is connected between the first node N1 and the input terminal of the high potential driving voltage VDD.

Figure 3:
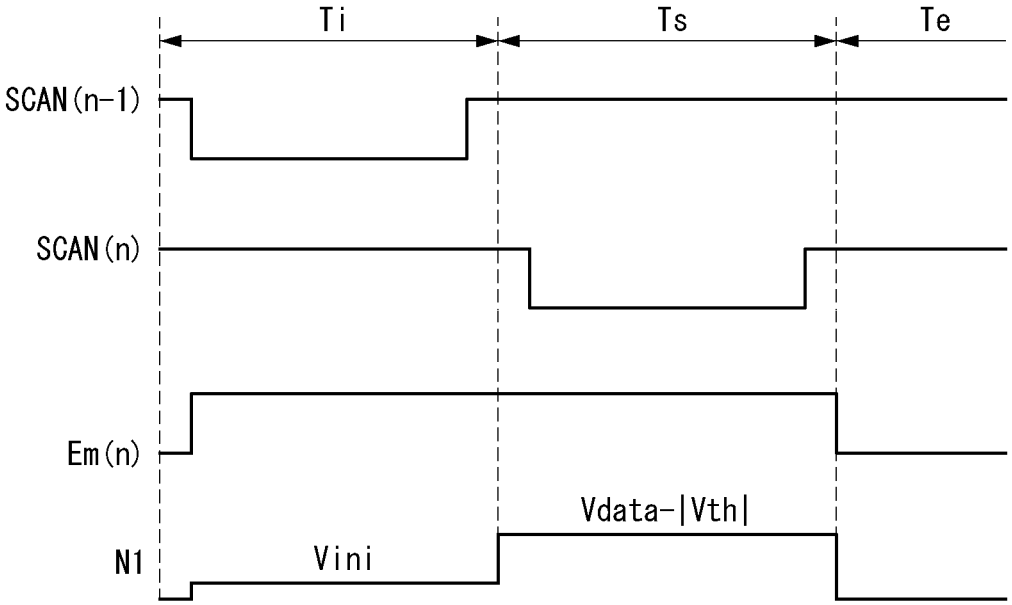
FIG. 3 is a timing chart of gate signals for driving the pixel illustrated in FIG. 2.

FIG. 3 is a timing chart of gate signals for driving the pixel illustrated in FIG. 2. Driving of the pixel will be described with reference to FIGS. 2 and 3.

During an initial period Ti, the fifth transistor T5 connects the first node N1 and the input terminal of the initialization voltage Vini in response to the (n−1)th scan signal SCAN (n−1). As a result, the first node N1 is initialized by the initialization voltage Vini. The initialization voltage Vini is selected within a voltage range sufficiently lower than an operating voltage of the organic light emitting diode OLED and may be set to be equal to or lower than the low potential driving voltage VSS.

During a sampling period Ts, the first transistor T1, the second transistor T2, and the sixth transistor T6 are turned on in response to the n-th scan signal SCAN(n). As a result, the first transistor T1 diode-connects the first node N1 and the second node N2. The second transistor T2 charges the third node N3 with the data voltage Vdata supplied from the data line DL. The sixth transistor T6 initializes the fourth node N4 with the initialization voltage Vini.

During the sampling period Ts, a current Ids flows between the source and the drain of the driving transistor DT, and accordingly, a voltage of the second node N2 is the sum of the data voltage Vdata and the threshold voltage Vth of the driving transistor DT (Vdata(n)+Vth). The first node N1 has the voltage equal to that of the second node N2.

During an emission period Te, the third transistor T3 supplies the high potential driving voltage VDD to the third node N3 in response to the nth emission signal EM(n). The fourth transistor T4 is then turned on and the second node N2 and the fourth node N4 are connected. During the emission period Te, a current, which passes from the third node N3 to the second node N2 according to the voltage set between the gate and the source of the driving transistor DT, is generated.

A driving current Ioled flowing in the organic light emitting diode OLED during the emission period Te is expressed by Equation 1 below.

$$\mathrm{IOLED}=k/2(\mathrm{Vgs}-\mathrm{Vth})^2=k/2(Vg-Vs-Vth)^2=k/2\{((V\mathrm{data}+Vth)-VDD-Vth)^2\} \quad \text{[Equation 1]}$$

Equation 1 is eventually expressed as "$k/2(\mathrm{Vdata}-\mathrm{VDD})^2$".

In Equation 1, k/2 represents a proportional constant determined by electron mobility, parasitic capacitance, channel capacity, and the like, of the driving transistor DT. As a result, during the light emitting (or emission) period Te, the driving current flowing through the organic light emitting diode OLED is not affected by the threshold voltage Vth of the driving transistor DT.

The driving method mainly based on the internal compensation method of the pixel circuit has been described. The display device according to the present disclosure distributes a data voltage in a time division manner using the multiplexer 30. The operation of distributing the data voltage in a time division manner using the multiplexer 30 will be described in detail.

Figure 4:
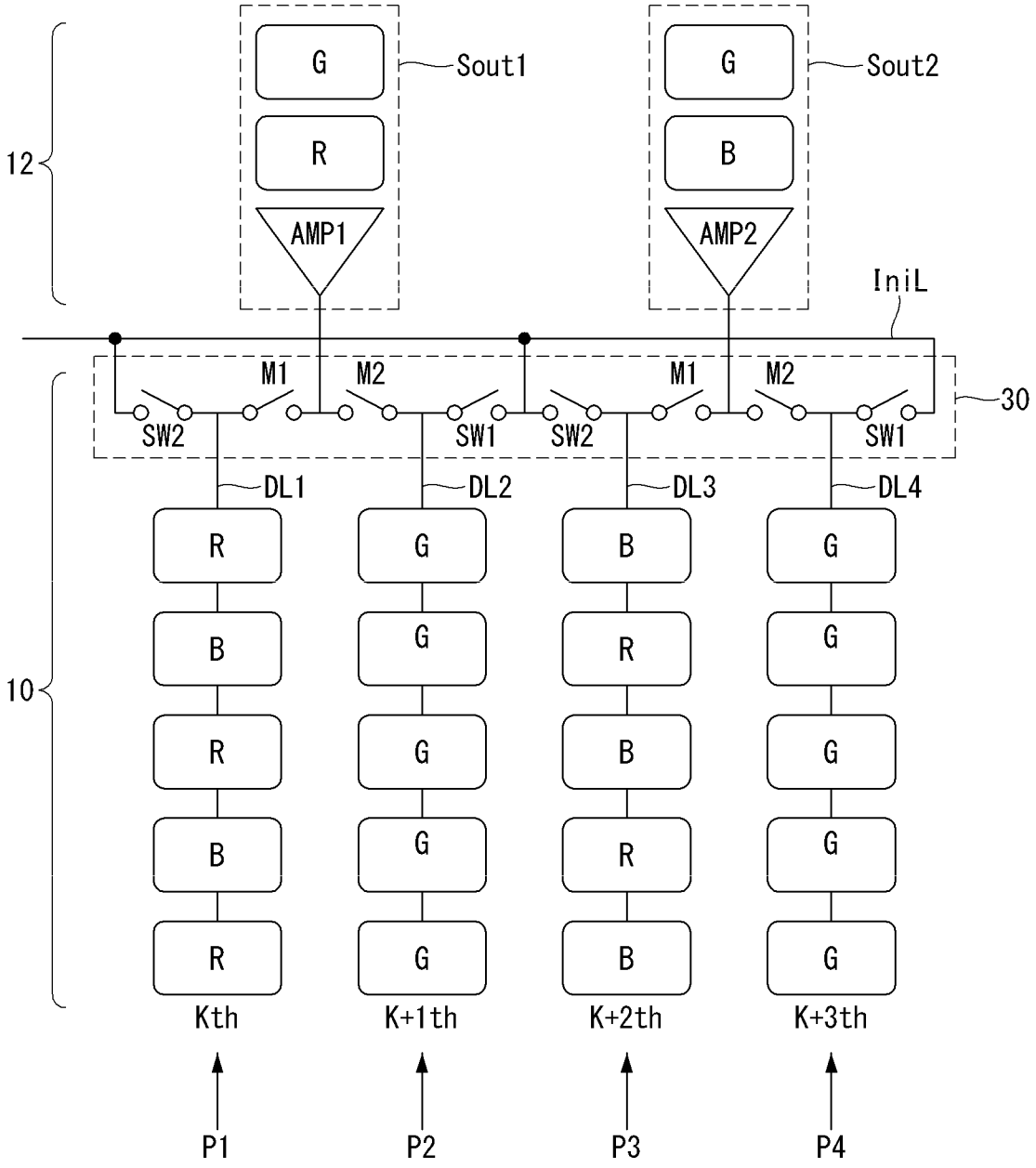
FIG. 4 is a view illustrating a multiplexer according to a first embodiment.
Figure 5:
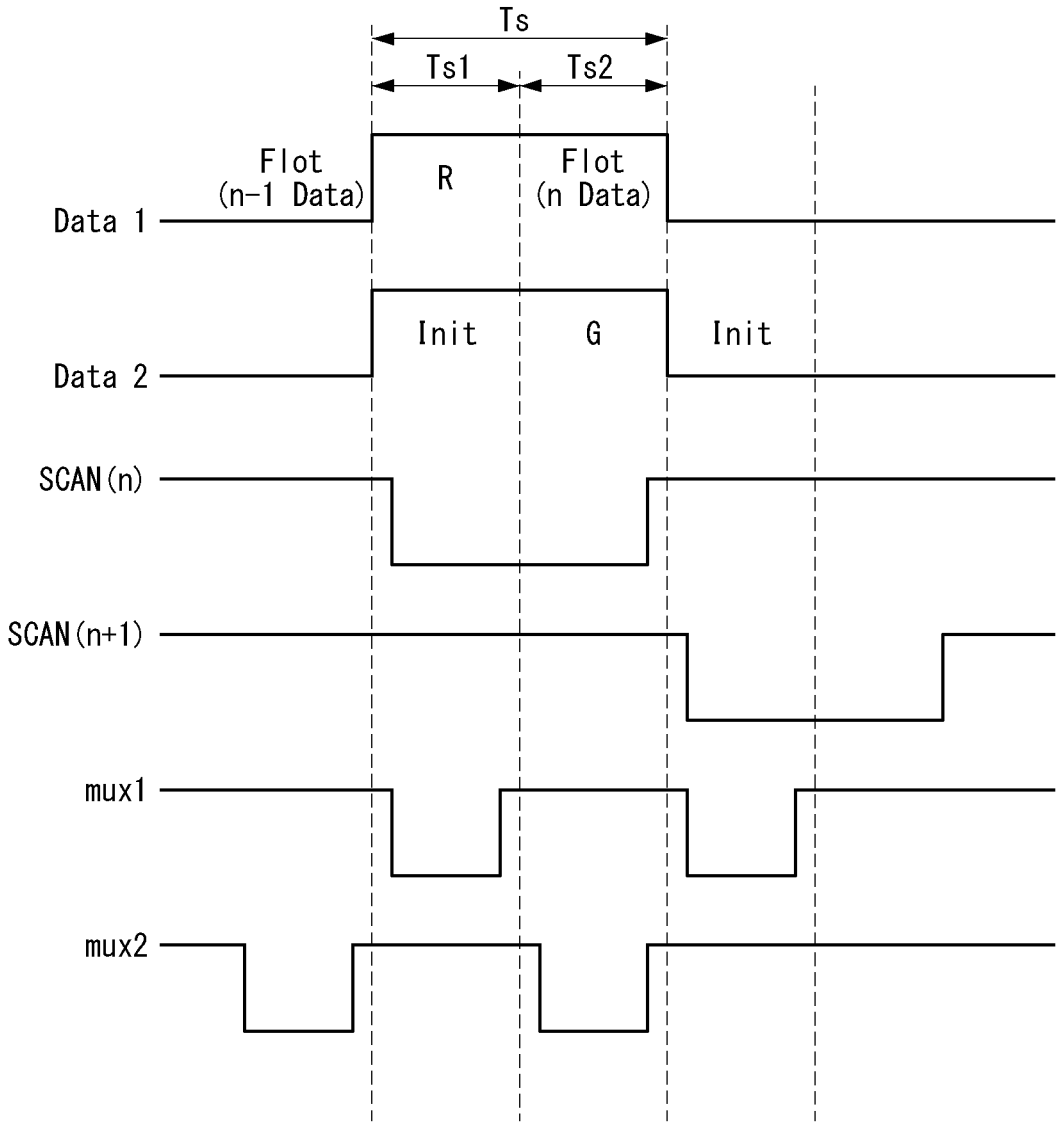
FIG. 5 is a timing chart of a multiplexer control signal according to the first embodiment.

FIG. 4 is a view illustrating a structure of a multiplexer distributing a data voltage of an output buffer of the data driver according to the first embodiment. FIG. 5 is a timing chart of scan signals during the sampling period and control signals for controlling the multiplexer.

Referring to FIG. 4, the multiplexer 30 distributes each of output buffers AMP1 and AMP2 of the data driver 12 to two data lines DL in a time division manner. Output channels Sout1 and Sout2 of the data driver 12 supply data voltages through the output buffers AMP1 and AMP2, respectively.

The multiplexer 30 distributes the data voltage output from the first output buffer AMP1 to the first data line DL1 and the second data line DL2 in a time division manner and distributes the data voltage output from the second output buffer AMP2 to the third data line DL3 and the fourth data line DL4 in a time division manner.

The multiplexer 30 includes data switching units M1 and M2 switching the output buffers AMP1 and AMP2 and the data lines DL and initialization voltage switching units SW1 and SW2 switching the initialization voltage line IniL and the data lines DL.

The data switching units M1 and M2 include first data switches M1 connecting the output buffers AMP1 and AMP2 and odd-numbered data lines DL1 and DL3 and second data switches M2 connecting the output buffers AMP1 and AMP2 and even-numbered data lines DL2 and DL4.

The initialization voltage switching units SW1 and SW2 include first initialization switches SW1 connecting the initialization voltage line IniL and the even-numbered data lines DL2 and DL4 and second initialization switches SW2 connecting the initialization voltage line IniL and the odd-numbered data lines DL1 and DL3.

The first data switches M1 and the first initialization switches SW1 are turned on in response to a first control signal MUX1 applied in the first sampling period Ts1. The second data switches M2 and the second initialization switches SW2 are turned on in response to a second control signal MUX2 applied during the second sampling period Ts2. As shown in FIG. 5, the first data switches M1 and the first initialization switches SW1 may be turned on during the first sampling period Ts1 in response to the first control signal MUX1 being at a low voltage level (e.g., a logic "0"), and the second data switches M2 and the second initialization switches SW2 may be turned on during the second sampling period Ts2 in response to the second control signal MUX2 being at a low voltage level. However, embodiments provided herein are not limited thereto, and in some embodiments, the various switches may be turned on by the first and/or second control signals MUX1, MUX2 being at a high voltage level.

As a result, during the first sampling period Ts1, the odd-numbered pixels P1 and P3 are supplied with the data voltage through the first data switches M1 and the odd-numbered pixels P2 and P4 are supplied with the initialization voltage IniL through the first initialization switches SW1.

During the second sampling period Ts2, the even-numbered pixels P2 and P4 are supplied with the data voltage through the second data switches M2 and the odd-numbered pixels P1 and P3 are supplied with the initialization voltage through the second initialization switches SW2.

Figure 6A:
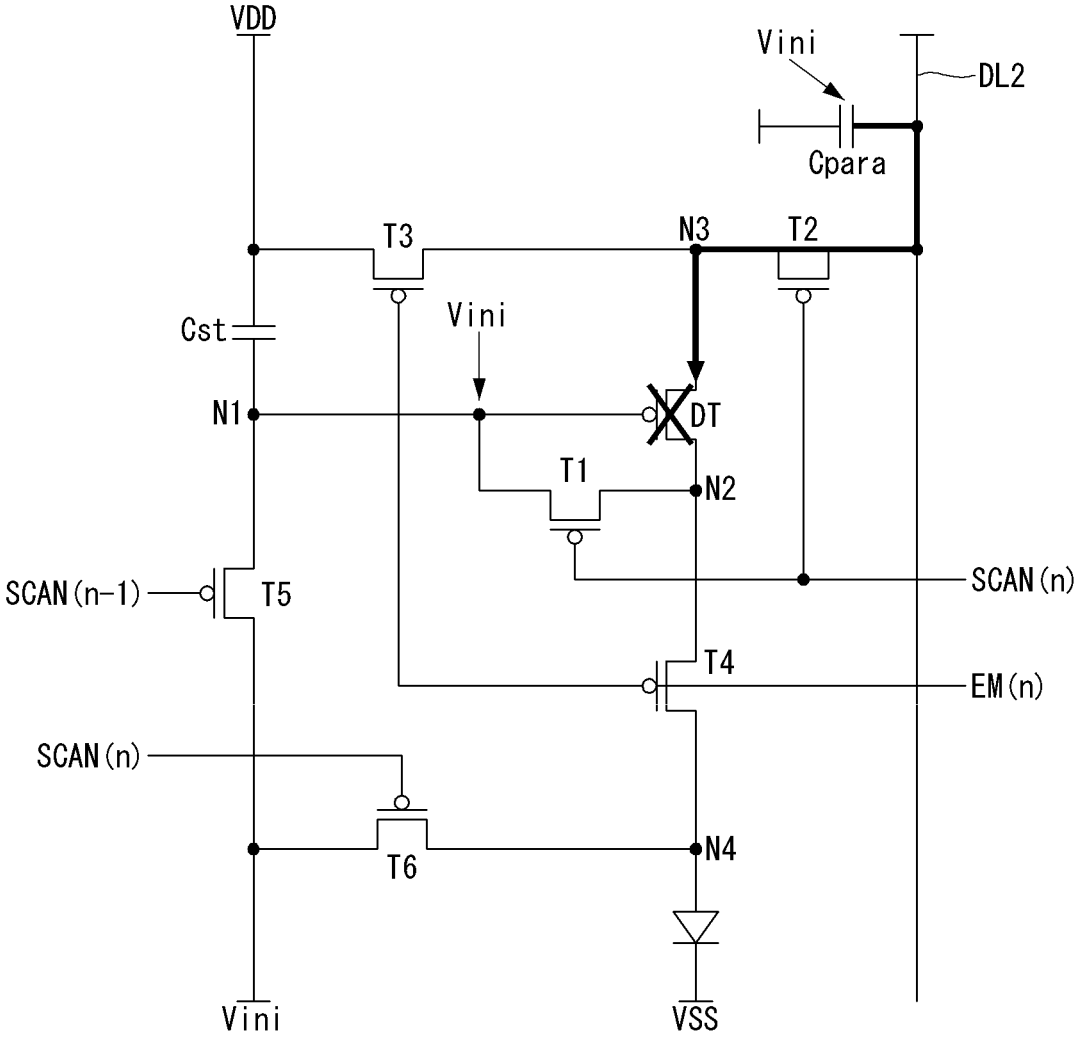
FIGS. 6A and 6B are views illustrating an operation during a sampling period of a pixel connected to a second data line.
Figure 6B:
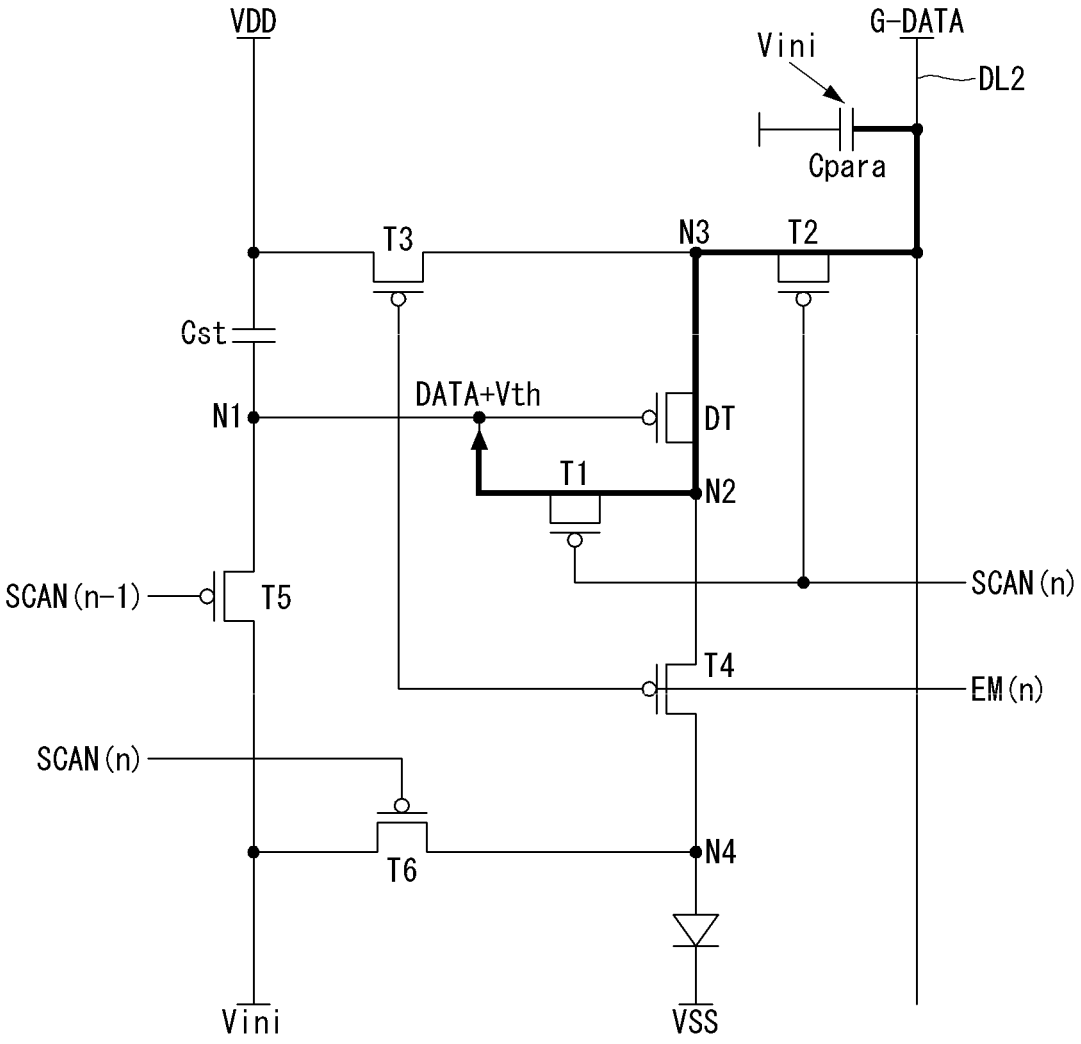

FIGS. 6A and 6B are views illustrating a sampling operation of pixels of the even-numbered column line, e.g., the second column line, during the first sampling period and the second sampling period, respectively. The first sampling period Ts1 is a period during which data voltages are supplied to the odd-numbered pixels among the pixels arranged in a certain pixel line, and the second sampling period Ts2 is a period during which data voltages are supplied to the even-numbered pixels among the pixels disposed in a certain pixel line. Hereinafter, the first sampling period Ts1 and the second sampling period Ts2 of the first pixel line HL1 will be described. In this disclosure, the pixels arranged in the kth column line will be referred to as first pixels, pixels arranged in the (k+1)th column line will be referred to as second pixels, pixels arranged in the (k+2)th column line will be referred to as third pixels, and pixels arranged in the (k+3)th column line will be referred to as fourth pixels.

Referring to FIGS. 5 and 6A, during the first sampling period Ts1, the first initialization switch SW1 is turned on in response to a first control signal MUX1. As a result, the second pixels P2 are supplied with the initialization voltage Vini from the initialization voltage line IniL. During the initial period, since the gate electrode of the driving transistor DT is in the state in which the initialization voltage is written, the voltage Vgs of the driving transistor DT does not have a potential difference during the first sampling period Ts1.

Referring to FIGS. 5 and 6B, during the second sampling period Ts2, the second data switch M2 connects the first output buffer AMP1 and the second data line DL2 in response to a second control signal MUX2. As a result, the second pixels P2 are supplied with the data voltage from the data line DL. During the second sampling period Ts2, the first transistor T1, the second transistor T2, and the sixth transistor T6 are turned on in response to the n-th scan signal SCAN(n). As a result, the first transistor T1 diode-connects the first node N1 and the second node N2. The second transistor T2 charges the third node N3 with the data voltage Vdata2 supplied from the second data line DL2. The sixth transistor T6 charges the fourth node N4 with the initialization voltage Vini.

As a result, during the second sampling period Ts2, the current Ids flows between the source and the drain of the driving transistor DT, and accordingly, the voltage of the second node N2 is equal to the sum (Vdata(n)+Vth) of the data voltage Vdata2 and the threshold voltage Vth of the driving transistor DT. The first node N1 has the same voltage as that of the second node N2.

As discussed above, in the organic light emitting display device according to the first embodiment, since the data voltages supplied by the output buffers are distributed using the multiplexer, the size of the data driver may be reduced to half. In particular, the initialization voltage Vini is applied to data lines which is not connected to the output buffers and is not supplied with the data voltage, among the data lines, whereby a previous data voltage charged in the parasitic capacitor Cpara of the data lines may be initialized.

If the initialization voltage Vini is not supplied to the second data line DL2 during the first sampling period Ts1, the second pixels P2 are floated. Thus, during the first sampling period Ts1, the parasitic capacitor Cpara formed in the second data line DL2 is in a state of being charged with the data voltage of the previous frame. During the second sampling period Ts2, the second pixels P2 are provided the data voltage supplied from the first output buffer AMP1 and the data voltage of the previous frame formed in the parasitic capacitor Cpara together. As a result, the second pixels P2 are not accurately sensed.

In contrast, in the present disclosure, when the pixels arranged in the same pixel line are supplied with the data voltage during the divided first and second sampling periods, the initialization voltage is applied to the data lines to initialize the data lines during a section of the first and second sampling periods in which the data voltage is not supplied. Therefore, the previous data voltage is prevented from participating in the sensing operation by the parasitic capacitor.

Figure 7:
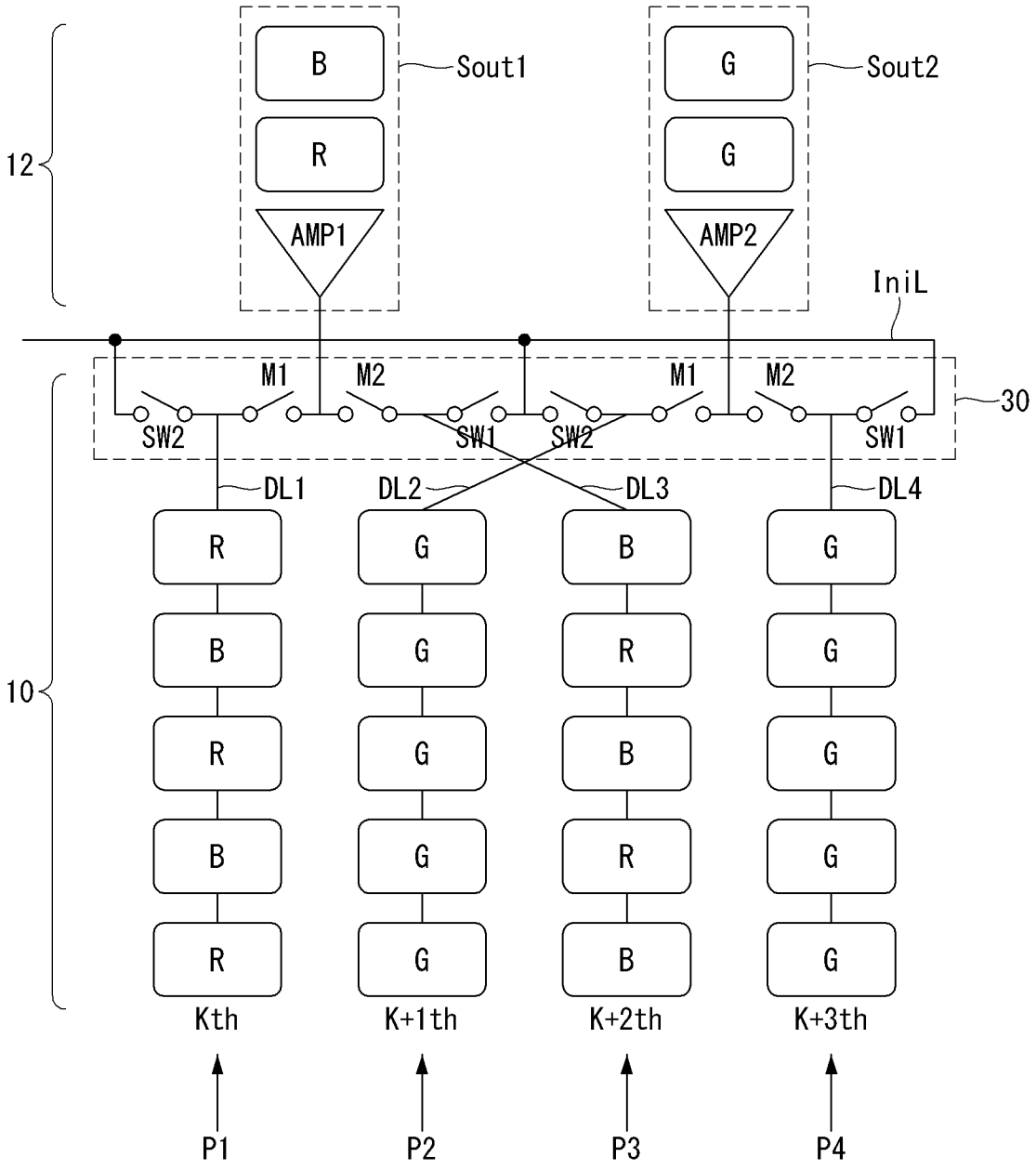
FIG. 7 is a view illustrating a multiplexer according to a second embodiment.
Figure 8:
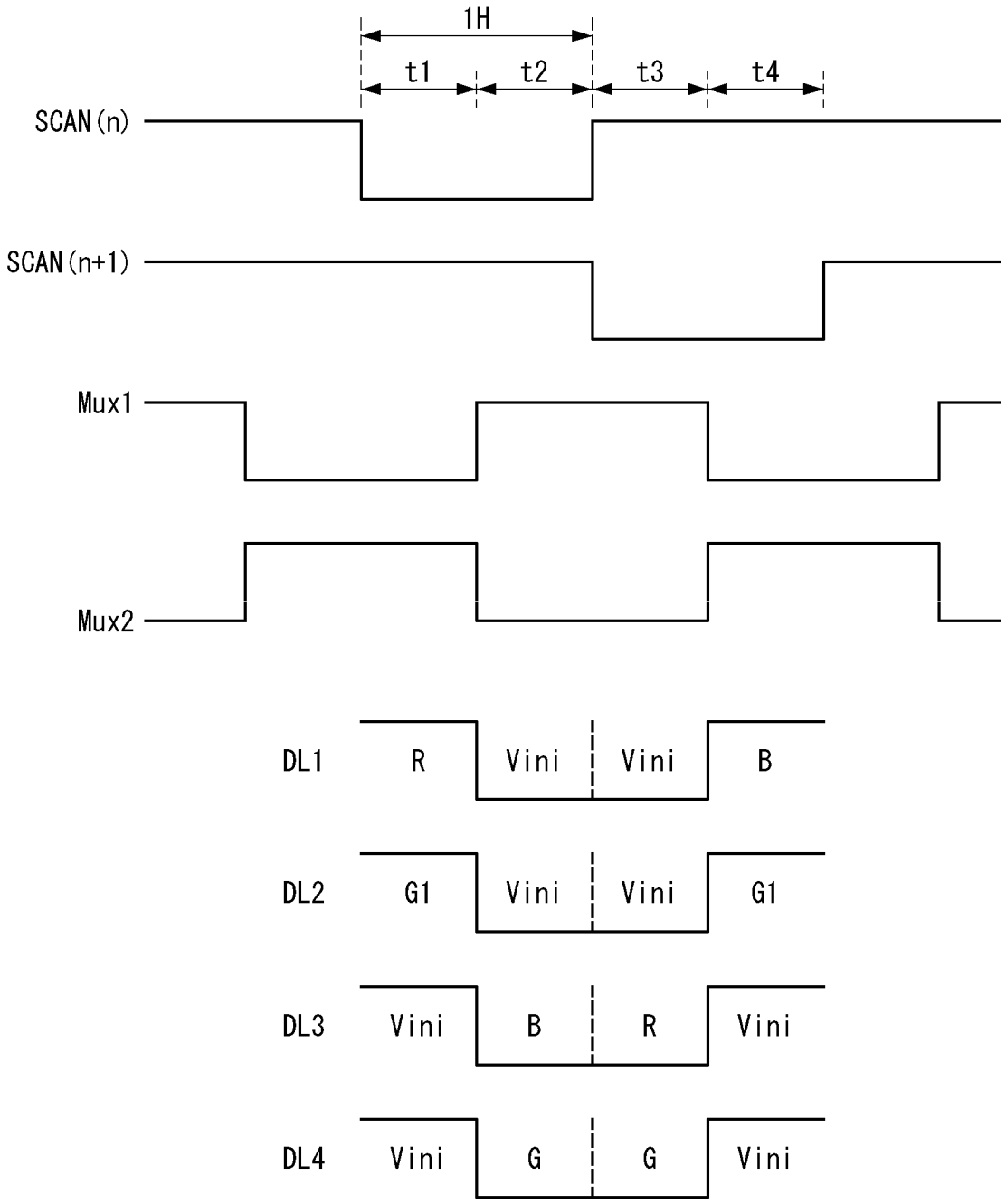
FIG. 8 is a timing chart of a multiplexer control signal according to the second embodiment.

FIG. 7 is a view illustrating a structure of a multiplexer according to a second embodiment of the present disclosure. FIG. 8 is a timing chart of scan signals and control signals for controlling a multiplexer according to the second embodiment.

Referring to FIGS. 7 and 8, the multiplexer 30 distributes the data voltages respectively output from the output buffers AMP1 and AMP2 of the data driver 12 to the two data lines DL in a time division manner. The data driver 12 generates the data voltages and outputs the data voltages through the first and second output buffers AMP1 and AMP2. The multiplexer 30 distributes the data voltage output from the first output buffer AMP1 to the first data line DL1 and the third data line DL3 in a time division manner and outputs the data voltage output from the second output buffer AMP2 to the second data line DL2 and the fourth data line DL4 in a time division manner. In addition, the multiplexer 30 includes switching elements connecting the data lines and the initialization voltage line IniL during a period in which the data lines DL are not supplied with the data voltage.

In detail, the multiplexer 30 includes data switching units M1 and M2 switching the output buffers AMP1 and AMP2 and the data lines DL and initialization voltage switching units SW1 and SW2 switching the initialization voltage line IniL and the data lines DL. The multiplexer 30 based on a configuration in which the data voltages supplied from the first and second output buffers AMP1 and AMP2 are distributed to the first to fourth data lines DL1 to DL4 will be described as follows.

The data switching units M1 and M2 include first and second data switches M1 and M2. In response to a first control signal MUX1, the first data switches M1 connect the first output buffer AMP1 and the first data line DL1 and connect the second output buffer AMP2 and the second data line DL2. In response to a second control signal MUX2, the second data switches M2 connect the first output buffer AMP1 and the third data line DL3 and connect the second output buffer AMP2 and the fourth data line DL4.

The initialization voltage switching units SW1 and SW2 include first and second initialization switches SW1 and SW2. The first initialization switches SW1 connect the initialization voltage line IniL and the third data line DL3 and connect the initialization voltage line IniL and the fourth data line DL4 in response to the first control signal MUX1.

The second initialization switches SW2 connect the initialization voltage line IniL and the first data line DL1 and connect the initialization voltage line IniL and the second data line DL2.

FIGS. 9A to 9D are views illustrating operations of distributing data voltages to first and second pixel lines by a multiplexer during a 2H period (e.g., two horizontal (H) periods, where each horizontal (H) period represents a period for supplying data voltages to pixels of a respective horizontal line of the display panel).

A first period t1 and the second period t2 are periods during which pixels arranged in the first pixel line HL1 are sampled while the nth scan signal SCAN(n) is being applied. The first period t1 is a first sampling period during which the data voltage is supplied in response to the first control signal MUX1 and the second period t2 is a second sampling during which the data voltage is supplied in response to the second control signal MUX2.

The third period t3 and the fourth period t4 are periods during which the pixels arranged in the second pixel line HL2 are sampled while the (n+1)th scan signal SCAN (n+1) is being applied. The third period t3 is a first sampling period during which the data voltage is supplied in response to the second control signal MUX2 and the fourth period t4 is a second sampling period during which the data voltage is supplied in response to the first control signal MUX1.

Figure 9A:
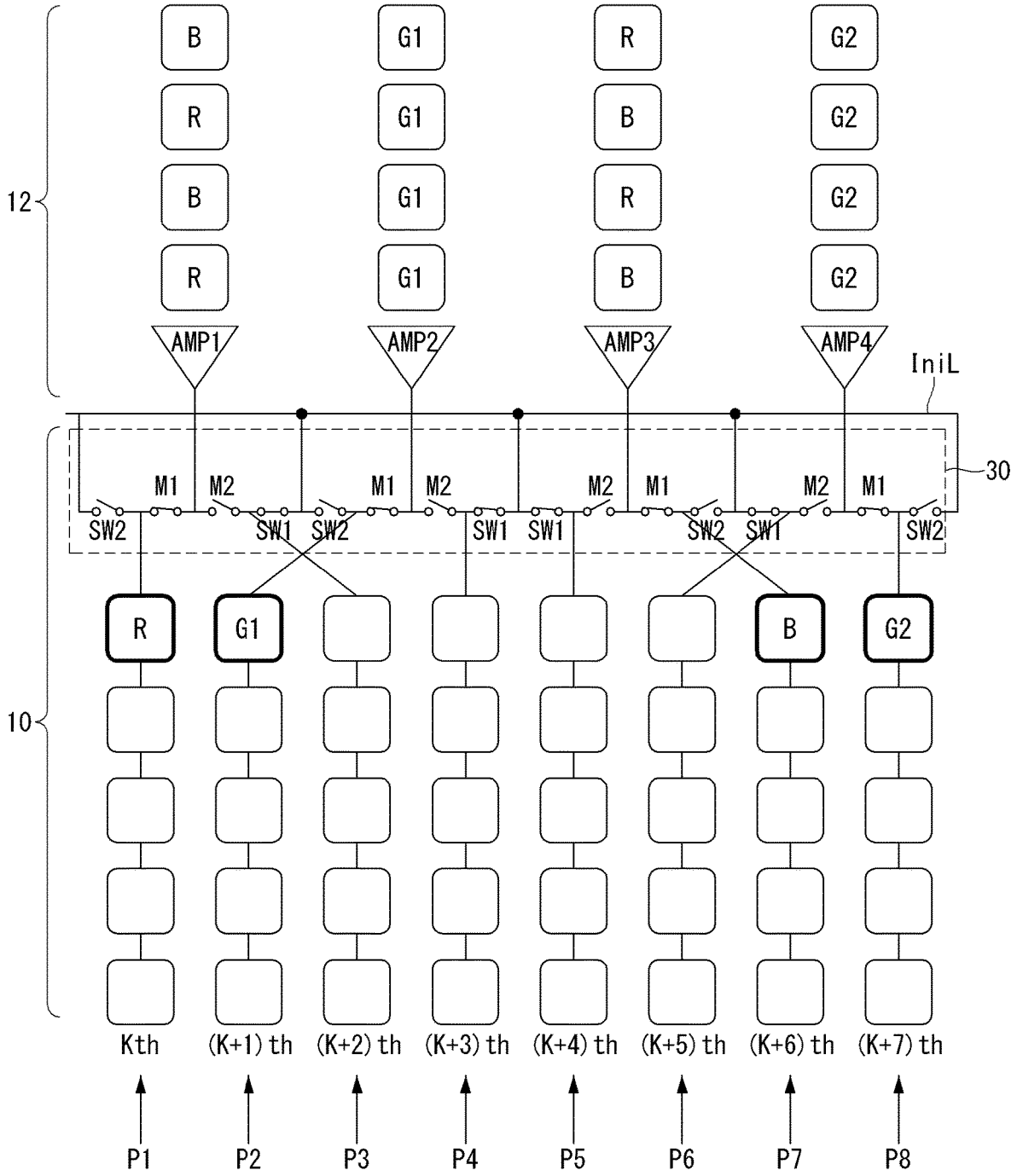
FIGS. 9A to 9D are views illustrating a way in which a multiplexer distributes data voltages according to the second embodiment.

Referring to FIGS. 8 and 9A, during the first period t1, the first data switches M1 are turned on in response to the first control signal MUX1. As a result, the first data line DL1 is supplied with a R_data voltage from the first output buffer AMP1 and the second data line DL2 is supplied with a G_data voltage from the second output buffer AMP2. Similarly, during the first period t1, the seventh and eighth data lines receive a B_data voltage and a G2_data voltage from the third and fourth output buffers AMP3, AMP4, respectively.

During the first period t1, the n-th scan signal SCAN(n) is a turn-on voltage and the first pixel P1 and the second pixel P2, which are arranged in the first pixel line HL1, perform a sampling operation. The sampling operation in the second embodiment is performed according to the same principle as that in the first embodiment described above, and thus, a detailed description will thereof be omitted.

During the first period t1, the first initialization switches SW1 are turned on in response to the first control signal MUX1. As a result, the third pixel P3 connected to the third data line DL3 and the fourth pixel P4 connected to the fourth data line DL4 are supplied with the initialization voltage Vini. During the first period t1, the third pixel P3 and the fourth pixel P4 which do not perform the sampling operation in the first pixel line HL1 are supplied with the initialization voltage, and thus, a phenomenon that the data line is floated so the data voltage of the previous frame is stored in the parasitic capacitor is prevented. Similarly, during the first period t1, the first initialization switches SW1 supply the initialization voltage Vini to the fifth and sixth pixels P5, P6 through the fifth and sixth data lines, respectively.

Figure 9B:
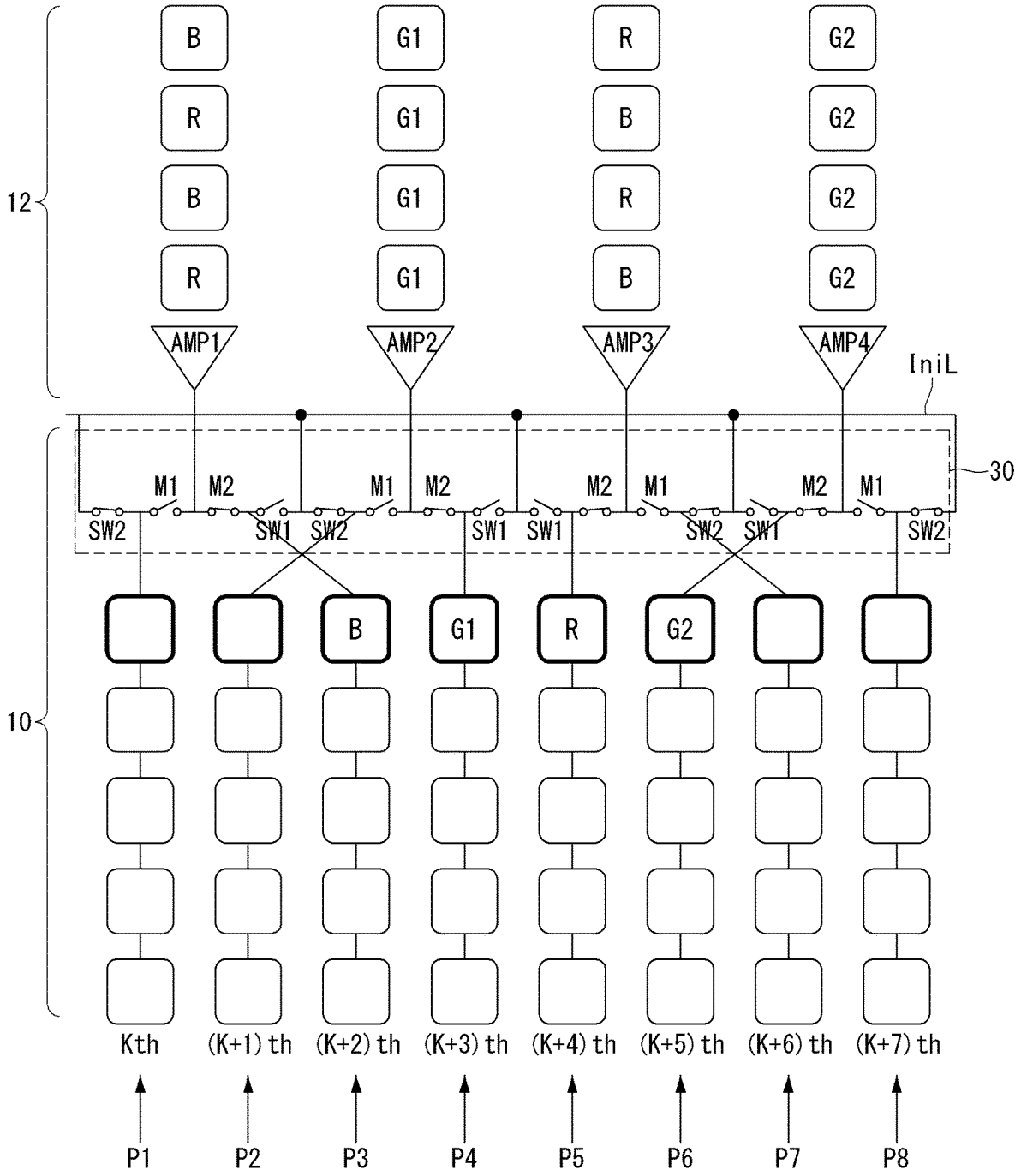

Referring to FIGS. 8 and 9B, during the second period t2, the second data switches M2 are turned on in response to the second control signal MUX2. As a result, the third data line DL3 is supplied with a B_data voltage from the first output buffer AMP1 and the fourth data line DL4 is supplied with a G1_data voltage from the second output buffer AMP2. During the second period t2, the nth scan signal SCAN(n) is a turn-on voltage and the third pixel P3 and the fourth pixel P4 in the first pixel line HL perform a sampling operation. Similarly, during the second period t2, the fifth and sixth data lines receive a R_data voltage and a G2_data voltage from the third and fourth output buffers AMP3, AMP4, respectively.

During the second period t2, the second initialization switches SW2 are turned on in response to the second control signal MUX2. As a result, the first pixel P1 connected to the first data line DL1 and the second pixel P2 connected to the second data line DL2 are supplied with the initialization voltage Vini. Similarly, during the second period t2, the second initialization switches SW2 supply the initialization voltage Vini to the seventh and eighth pixels P7, P8 through the seventh and eighth data lines, respectively.

Figure 9C:
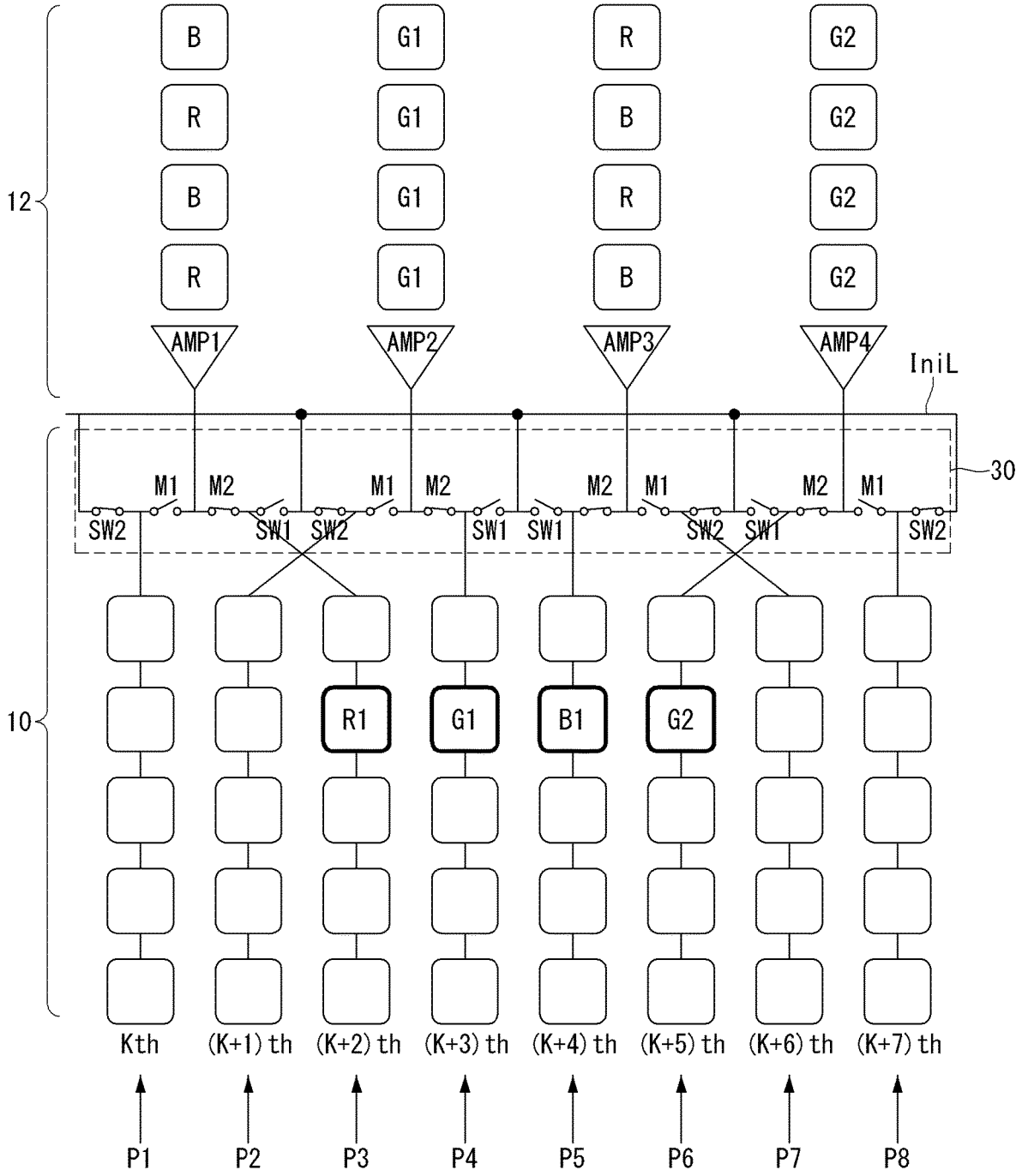

Referring to FIGS. 8 and 9C, during the third period t3, the second data switches M2 maintain the turn-on state. As a result, the third data line DL3 is supplied with an R_data voltage from the first output buffer AMP1 and the fourth data line DL4 is supplied with a G1_data voltage from the second output buffer AMP2. During the third period t3, the (n−1)th scan signal SCAN (n−1) is a turn-on voltage and the third pixel P3 and the fourth pixel P4 in the second pixel line HL2 perform a sampling operation. Similarly, the fifth and sixth data lines are supplied with a B_data voltage and a G2_data voltage from the third and fourth output buffers AMP3, AMP4, respectively.

During the third period t3, the second initialization switches SW2 are turned on in response to the second control signal MUX2. As a result, the first pixel P1 connected to the first data line DL1 and the second pixel P2 connected to the second data line DL2 are supplied with the initialization voltage Vini. Similarly, during the third period t3, the second initialization switches SW2 supply the initialization voltage Vini to the seventh and eighth pixels P7, P8 through the seventh and eighth data lines, respectively.

Figure 9D:
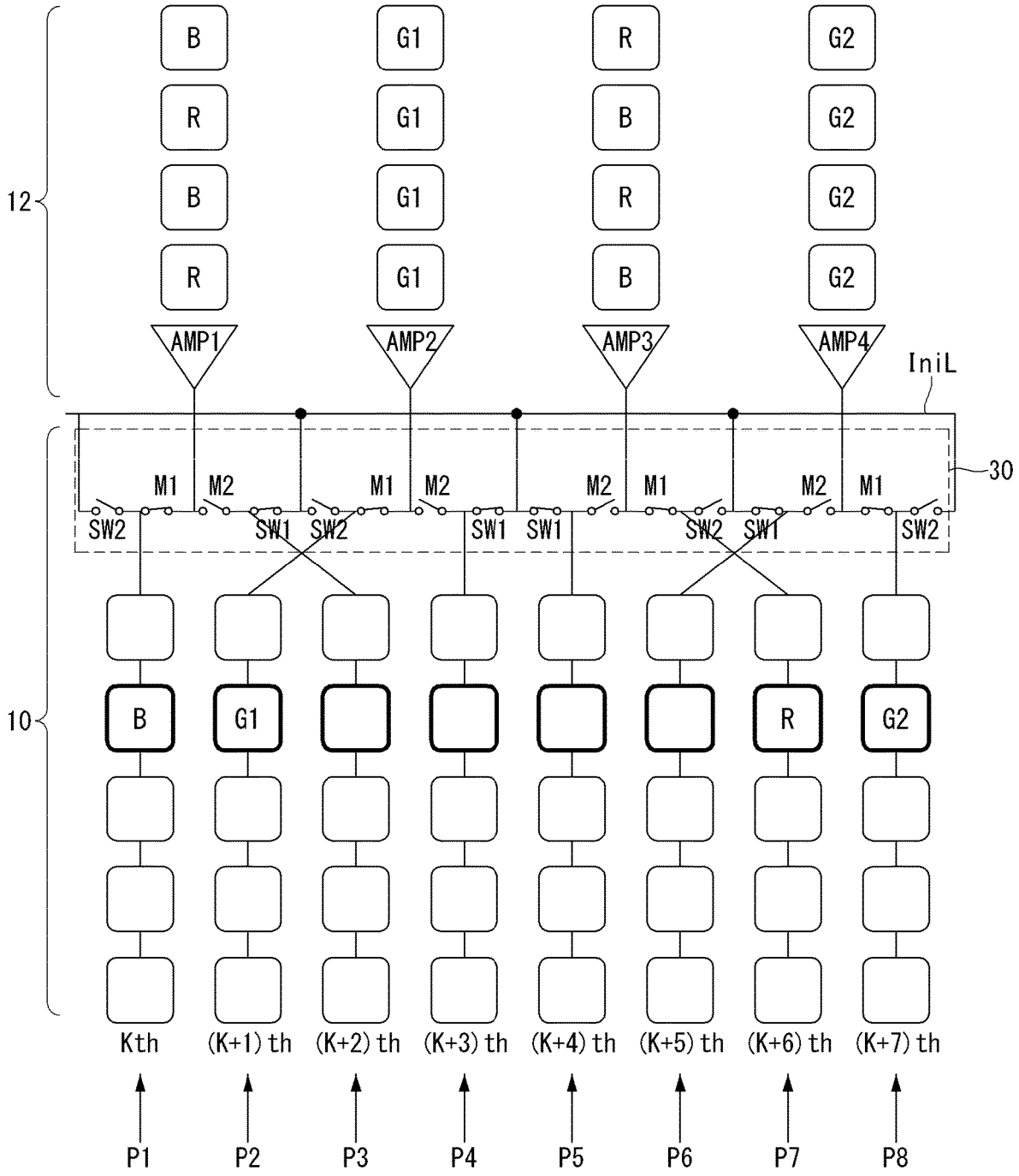

Referring to FIGS. 8 and 9D, during a fourth period t4, the first data switches M1 are turned on in response to the first control signal MUX1. As a result, the first data line DL1 is supplied with a B_data voltage from the first output buffer AMP1 and the second data line DL2 is supplied with a G1_data voltage from the second output buffer AMP2. Similarly, the seventh and eighth data lines are supplied with a R_data voltage and a G2_data voltage from the third and fourth output buffers AMP3, AMP4, respectively.

During the fourth period t4, the (n−1)th scan signal SCAN (n_1) is a turn-on voltage and the first pixel P1 and the second pixel P2 arranged in the second pixel line HL2 perform a sampling operation.

During the fourth period t4, the first initialization switches SW1 are turned on in response to the first control signal MUX1. As a result, the third pixel P3 connected to the third data line DL3 and the fourth pixel P4 connected to the fourth data line DL4 are supplied with the initialization voltage Vini. Similarly, during the fourth period t4, the first initialization switches SW1 supply the initialization voltage Vini to the fifth and sixth pixels P5, P6 through the fifth and sixth data lines, respectively.

In the second embodiment, since the output periods of the first control signal MUX1 and the second control signal MUX2 are set to 1H (e.g., one horizontal period), sections in which the data lines are floated when they are not directly supplied with the data voltages from the output buffers AMP1 and AMP2 during the sampling period may all be removed.

In the second embodiment, during the second period t2, the first output buffer AMP1 and the second output buffer AMP2 and the second data line DL2 and the third data line DL3 are connected in a crossing manner, and thus, there is no need to manufacture a new data driver 12 in which output order of data voltages is changed to use the multiplexer 30.

Pentile type pixel arrays illustrated in FIGS. 9A to 9D are pixel arrays in which pixels of R, G, B and G colors are repeated in the odd-numbered pixel lines HL1 and HL3 and pixels of B, G, R, and G colors are repeated in the even-numbered pixel lines HL2 and HL4. That is, the R and B pixels are repeated in the odd-numbered column lines and the G pixels are repeated in the even-numbered column lines. In a general data driver which does not employ a multiplexer corresponding to the pixel array, the odd-numbered output buffers alternately output data voltages of R and B colors and the even-numbered output buffers output data voltages of G color.

When the multiplexer according to the first embodiment is applied to the pentile type pixel arrays illustrated in FIGS. 9A to 9D, the data voltages in order of R, B, G, G, rather than data voltages in order of R, G, B, G, are sequentially written into the first pixel line. Thus, it is difficult to apply the multiplexer of the first embodiment as is to the pentile type display device.

However, in the multiplexer according to the second embodiment, the data voltage of the first output buffer AMP1 is supplied to the first data line DL1 and the third data line DL3 and the data voltage of the second output buffer AMP2 is supplied to the second data line DL2 and the fourth data line DL4. As a result, as discussed above with reference to FIGS. 9A to 9D, although the first output buffer AMP1 outputs R, B, R, B in this order and the second output buffer AMP2 outputs the color G, G, G, G, the multiplexer 30 distributes the data voltages to correspond to the pixel array structure.

In the display device according to the second embodiment, a turn-on period of the control signals MUX1 and MUX2 for controlling the multiplexer 30 is 1H period. That is, in the second embodiment, since the turn-on period of the control signals MUX1 and MUX2 is twice that in the first embodiment, transition of the control signals MUX1 and MUX2 is reduced to half and power consumption for outputting the control signals may be reduced.

In the present disclosure, in the process of distributing the data voltages in the time division manner, the initialization voltage is supplied to the pixels which are not supplied with the data voltage. Thus, the data line is prevented from being floated while the data voltage is not being supplied, thus preventing a previous data voltage from remaining in the parasitic capacitor of the data line.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light emitting display device, comprising:

a display panel including:

first to fourth pixels sequentially arranged in a pixel row extending along a first direction from the first pixel to the fourth pixel; and first to fourth data lines respectively connected to the first to fourth pixels;

a data driver including:

a first output buffer supplying data voltages to the first and third data lines; and a second output buffer supplying data voltages to the second and fourth data lines; and a multiplexer distributing the data voltages from the first output buffer to the first and third data lines in a time division manner and distributing the data voltages from the second output buffer to the second and fourth data lines in a time division manner, wherein the multiplexer connects at least one of the first to fourth data lines, which is not connected to the first and second output buffers, to an initialization voltage line providing an initialization voltage.

2. The organic light emitting display device of claim 1, wherein the multiplexer includes:

first data switches connecting the first output buffer and the first data line and connecting the second output buffer and the second data line, in response to a first control signal; and second data switches connecting the first output buffer and the third data line and connecting the second output buffer and the fourth data line, in response to a second control signal, the second control signal being out-of-phase with respect to the first control signal.

3. The organic light emitting display device of claim 2, wherein the multiplexer includes:

first initialization switches connecting the third and fourth data lines to the initialization voltage line in response to the first control signal; and second initialization switches connecting the first and second data lines to the initialization voltage line in response to the second control signal.

4. The organic light emitting display device of claim 2, wherein the pixels each include an organic light emitting diode (OLED) and a driving transistor driving the OLED, and the initialization voltage is a turn-off voltage of the OLED.

5. The organic light emitting display device of claim 4, wherein in each of the first to fourth pixels arranged in an nth pixel line, during an initialization period, a gate electrode of the driving transistor is initialized by the initialization voltage, during a first sampling period that follows the initialization period, the first control signal becomes a turn-on voltage and applies respective data voltages to source electrodes of the driving transistors of the first and second pixels, and during a second sampling period that follows the first sampling period, the second control signal becomes a turn-on voltage and applies respective data voltages to the source electrodes of the driving transistors of each of the third and fourth pixels.

6. The organic light emitting display device of claim 5, wherein the multiplexer further includes:

initialization switches connecting the third and fourth data lines to the initialization voltage line during the first sampling period, and connecting the first and second data lines to the initialization voltage line during the second sampling period.

7. The organic light emitting display device of claim 1, wherein an output period of each of the first and second control signals is one horizontal period (1H) during which data is written into one pixel line.

8. The organic light emitting display device of claim 7, wherein an nth sampling period during which data is written into an nth pixel line includes a first sampling period and a second sampling period, and the first control signal maintains a turn-on voltage during the second sampling period of the nth sampling period and during a first sampling period of an (n+1)th sampling period.

9. The organic light emitting display device of claim 1, wherein the first to fourth pixels are arranged in an odd-numbered pixel line of the display panel are red (R), green (G), blue (B), and green (G) color pixels, respectively, and first to fourth pixels in an even-numbered pixel line of the display panel are B, G, R, G color pixels, respectively, and pixels of the R color are arranged in a same column line.

10. The organic light emitting display device of claim 1, wherein the multiplexer connects the first and third data lines to the first output buffer at a same time as the multiplexer connects the second and fourth data lines to the initialization voltage line.

11. The organic light emitting display device of claim 1, wherein the multiplexer is disposed between the data driver and a first side of the display panel, and the multiplexer provides the data voltages and the initialization voltage to the first side of the display panel.

12. A device, comprising:

a display panel including:

a plurality of pixels arranged in a plurality of horizontal pixel lines and a plurality of pixel columns; and a plurality of data lines, each of the data lines being electrically connected to a respective one of the pixel columns;

a data driver including a plurality of output buffers; and a multiplexer electrically coupled between the data driver and the display panel, the multiplexer being configured to, during a first time period:

electrically couple a first output buffer to a first data line;

electrically couple a second output buffer to a second data line, the second data line being adjacent to the first data line;

electrically couple a third data line to an initialization voltage, the third data line being between the second data line and a fourth data line;

electrically couple the fourth data line to the initialization voltage;

during a second time period immediately subsequent to the first time period;

electrically couple the first output buffer to the third data line;

electrically couple the second output buffer to the fourth data line; and electrically couple the first and second data lines to the initialization voltage.

13. The device of claim 12, wherein the multiplexer includes:

a plurality of first data switches which selectively couple the first output buffer to the first data line and the second output buffer to the second data line; and a plurality of second data switches which selectively couple the first output buffer to the third data line and the second output buffer to the fourth data line.

14. The device of claim 13, wherein the multiplexer is configured to selectively couple the first output buffer to the first data line and the second output buffer to the second data line based on a first control signal, and to selectively couple the first output buffer to the third data line and the second output buffer to the fourth data line based on a second control signal.

15. The device of claim 14, wherein the first and second control signals are out-of-phase with respect to one another.

16. The device of claim 15, wherein the plurality of first data switches selectively couple a third output buffer to a seventh data line, and selectively couple a fourth output buffer to an eighth data line, and the plurality of second data switches selectively couple the third output buffer to a fifth data line, and selectively couple the fourth output buffer to a sixth data line, the fifth through eighth data line.

17. The device of claim 16, wherein the multiplexer is configured to, during the first time period:

electrically couple the third output buffer to the seventh data line;

electrically couple the fourth output buffer to the eighth data line; and electrically couple the fifth and sixth data lines to the initialization voltage.

18. The device of claim 17, wherein the multiplexer is configured to, during the second time period:

electrically couple the third output buffer to the fifth data line;

electrically couple the fourth output buffer to the sixth data line; and electrically couple seventh and eighth data lines to the initialization voltage.

* * * * *